US006472928B1

(12) United States Patent
Kadanka

(10) Patent No.: US 6,472,928 B1
(45) Date of Patent: Oct. 29, 2002

(54) REDUCED NOISE BAND GAP REFERENCE WITH CURRENT FEEDBACK AND METHOD OF USING

(75) Inventor: Petr Kadanka, Valasska Bystrice (CZ)

(73) Assignee: Semiconductor Components Industries LLC, Phoenix, AZ (US)

( * ) Notice: Subject to any disclaimer, the term of this patent is extended or adjusted under 35 U.S.C. 154(b) by 0 days.

(21) Appl. No.: 09/848,198

(22) Filed: May 4, 2001

(51) Int. Cl.[7] ..... G05F 1/10
(52) U.S. Cl. ..... 327/538
(58) Field of Search ..... 327/530, 534, 327/535, 537, 538, 539, 540, 541, 543

(56) References Cited

U.S. PATENT DOCUMENTS 6,157,245 A * 12/2000 Rincon ..... 327/513
6,181,196 B1 * 1/2001 Nguyen ..... 327/539
6,271,652 B1 * 8/2001 Burstein et al. ..... 323/313

* cited by examiner

*Primary Examiner*—Jeffrey Zweizig

(57) ABSTRACT

A band gap reference (32) provides low noise operation utilizing capacitor (98) to produce a low pass filter operating with high impedance node (104). Increased speed is realized using feedback signals at nodes (102) and (100) to control differential transistor pair (36, 42). A first current feedback stage using transistors (44, 50, 52 and 54) and a second current feedback stage using transistors (60, 62, 68, 70) is used to control current mirror stages which set the charge and discharge current at node (104). A first current mirror stage using transistors (64,76) comprise the current sink used to discharge capacitor (98) at node (104) and a second current mirror stage using transistors (58,74) comprise the current source used to charge capacitor (98) at node (104).

10 Claims, 2 Drawing Sheets

REDUCED NOISE BAND GAP REFERENCE WITH CURRENT FEEDBACK AND METHOD OF USING

BACKGROUND OF THE INVENTION

The present invention relates in general to band gap references and, more particularly, to bypassed band gap references with current feedback.

Stable reference voltages are commonly used in electronic devices such as comparison circuits and analog to digital conversion circuits. The stable reference is required to achieve a high degree of accuracy when using the reference voltage, for example, as a first input to a comparator. The second input to the comparator is used to receive a signal used to compare against the reference voltage. A logic one, for example, is provided by the comparator if the input signal is above the reference voltage and a logic zero, for example, is provided by the comparator if the input signal is below the reference voltage. In many applications, the comparison performed by the comparator circuit must be as accurate as possible. One contributing factor to the inaccuracy of the comparison is, for example, noise contributed by the band gap reference itself.

Prior art band gap references provide an external bypass capacitor to reduce the noise level of the reference. Using a bypass capacitor, however, creates a system which takes a substantial amount of time to become stable, due to the charging requirements of the bypass capacitor. Other prior art reference circuits provide a pre-charge block which pre-charges the bypass capacitor to decrease the amount of time required to produce a stable reference voltage. Such prior art designs, however, require comparators, switches and miscellaneous additional circuitry to sense that the bypass capacitor is charged, so that the charging signal is terminated upon creating an acceptable charge across the bypass capacitor. The sensing circuitry increases the complexity of the reference voltage design and increases the quiescent current which is generally an issue in low power designs.

Hence, there is a need for a band gap reference circuit which provides reduced noise and fast response without the additional sensing circuitry.

DETAILED DESCRIPTION OF THE DRAWINGS

Figure 1:
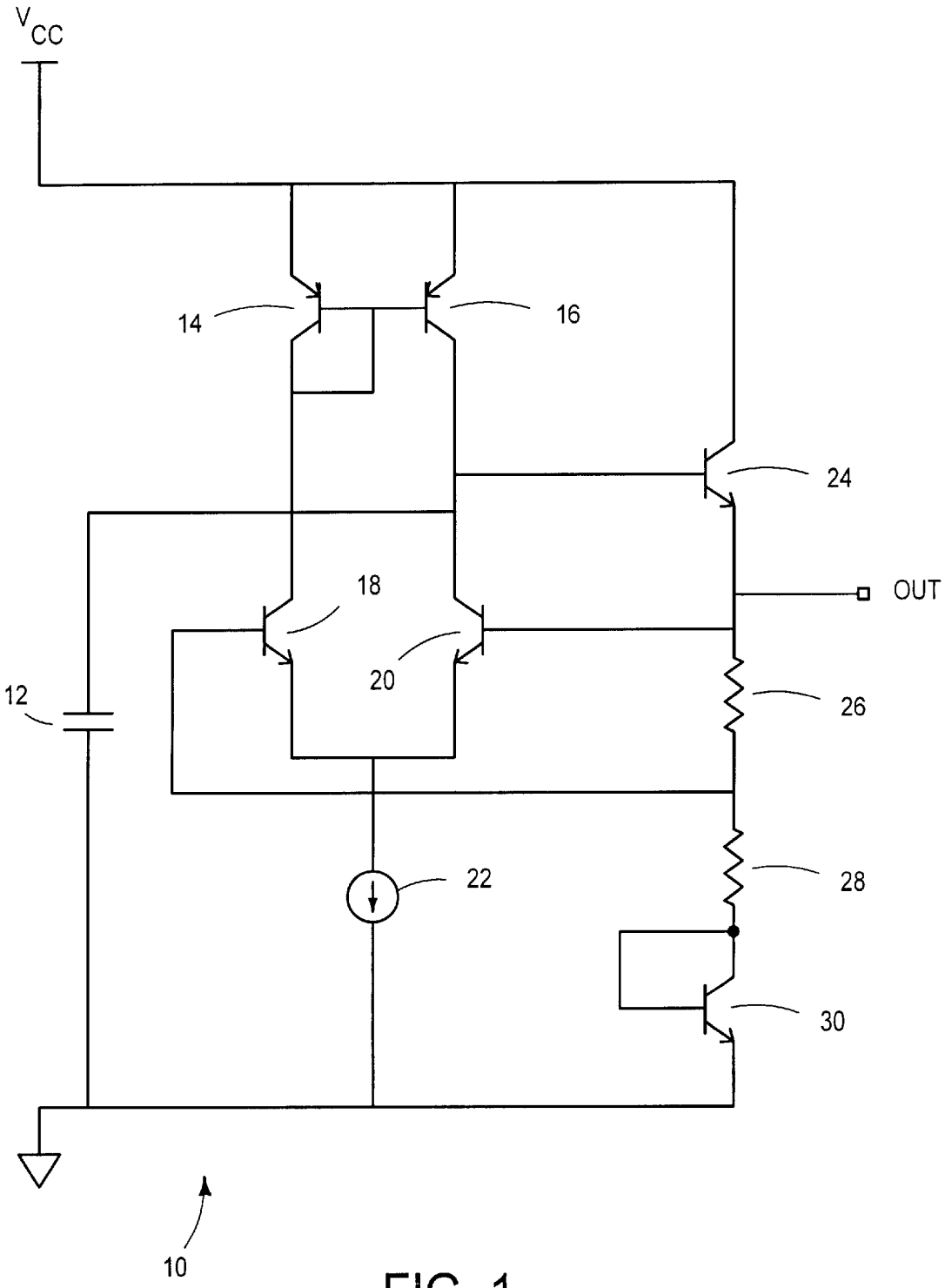
FIG. 1 Prior Art
FIG. 1 is a schematic diagram illustrating a prior art band gap reference using a bypass capacitor for noise reduction.

In FIG. 1, a prior art band bap reference 10 is illustrated. Band gap reference 10 receives input voltage $V_{cc}$ and provides a band gap reference voltage approximately equal to 1.25 volts at terminal OUT. Transistor 18 is provided having an emitter area larger than the emitter area of transistor 20. A first voltage approximately equal to the base-emitter potential across transistor 20 is applied to a first conductor of resistor 26. A second voltage approximately equal to the base-emitter potential across transistor 18 is applied to a second conductor of resistor 26. Since the emitter area of transistor 18 is larger than the emitter area of transistor 20, a steady state difference voltage is applied across resistor 26. The steady state difference voltage applied across resistor 26 is due to the difference in base-emitter potentials developed across transistors 18 and 20. The difference voltage applied across resistor 26 develops a difference current in resistor 28 and diode connected transistor 30. The difference current creates a potential drop across resistor 28. The sum of voltages developed across diode connected transistor 30, resistor 28 and resistor 26 creates the band gap reference voltage at terminal OUT. An amplification stage is created by transistors 18, 20, 14 and 16. Transistors 18 and 20 combine to form a differential amplifier and transistors 14 and 16 combine to form a current mirror. The common connected collectors of transistors 16 and 20 at the base terminal of transistor 24 creates a node of very high impedance. A bypass capacitor 12 placed at the node of very high impedance to ground potential creates a low pass filter having a cut-off frequency of $f_{cutoff}=1/2\pi R_d C_{bypass}$, where $R_d$ is the equivalent dynamic impedance at the base terminal of transistor 24 and $C_{bypass}$ is the capacitance value of capacitor 12. The use of the bypass capacitor, therefore, generates a noise filter which attenuates high frequency noise components at terminal OUT.

A disadvantage of the reference circuit of FIG. 1 is the low quiescent current capability of current source 22, which provides slow charging of capacitor 12. Typical values for current source 22 are between 1 and 10 microamps (uA). Typical values for bypass capacitor 12 is in the range of nanofarads (nF). At startup, capacitor 12 contains no charge storage and must be charged up. In other words, the voltage value at the base terminal of transistor 24 is substantially at ground potential and must derive charging current from current source 22 before reference circuit 10 is able to provide a stable reference voltage at terminal OUT. Charging current provided by current source 22, however, is between 1 and 10 uA, for example, which necessitates an extended charging time for capacitor 12. As discussed earlier, a complicated pre-charge block is necessary to pre-charge capacitor 12 to improve the dynamic performance of reference 10. A pre-charge block, however, necessitates a detection of the voltage across bypass capacitor 12 in order to determine the activation of the pre-charge block.

Figure 2:
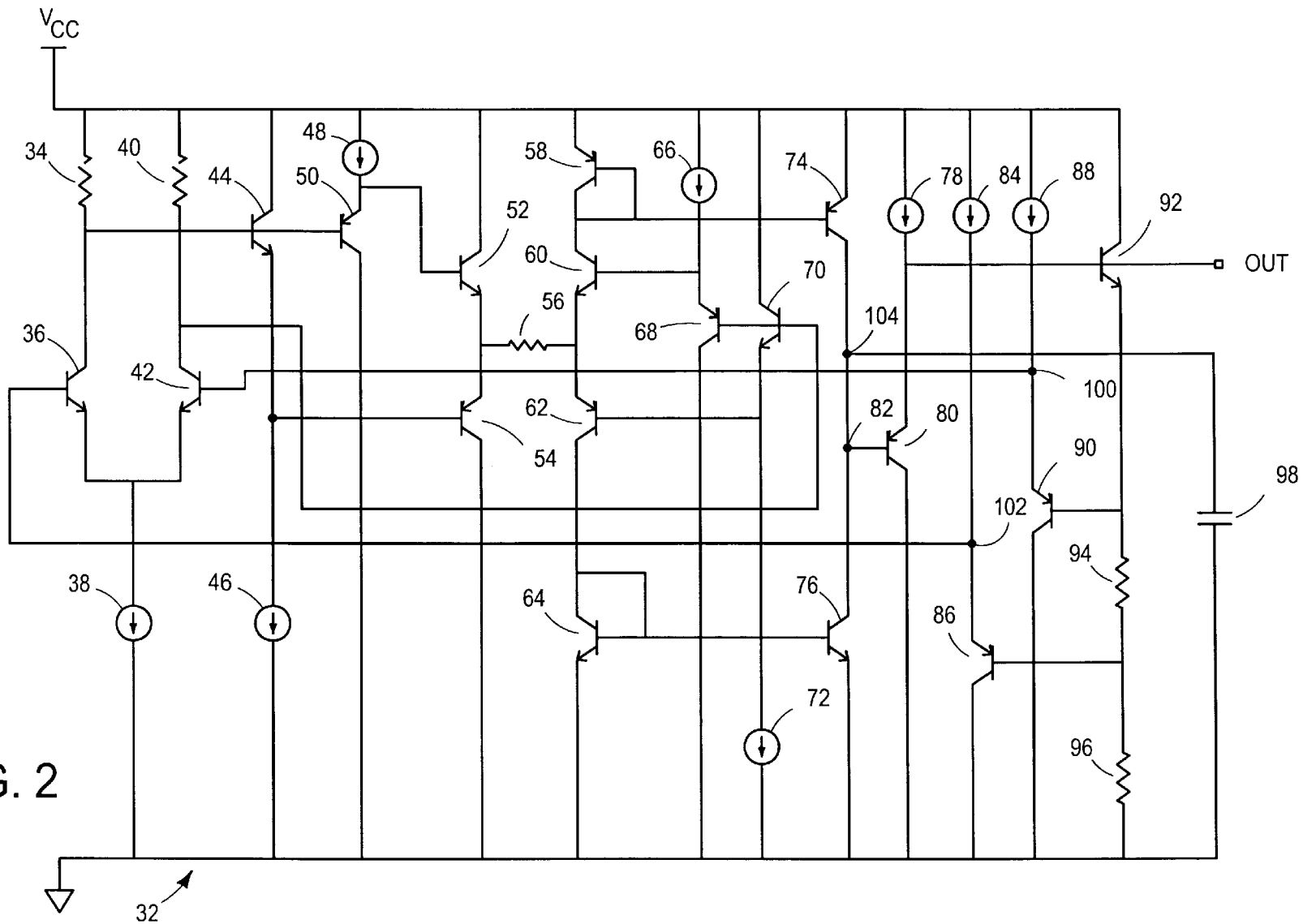
FIG. 2 is a schematic of a reduced noise band gap reference with current feedback.

Turning to FIG. 2, a schematic diagram of a reduced noise, current feedback band gap reference is illustrated. Two stages of current feedback are implemented where the first stage of current feedback is implemented by transistors 44, 50, 52 and 54 and the second stage of current feedback is implemented by transistors 60, 62, 68 and 70. Differential amplifier composed of transistors 36 and 42 have base terminals connected to nodes 102 and 100, respectively. The emitter terminals of transistors 36 and 42 are coupled together at a first conductor of current source 38. A second terminal of current source 38 is coupled to the bottom rail supply terminal, for example, ground potential. The collector terminals of transistors 36 and 42 are coupled to first conductors of resistors 34 and 40 respectively. Second conductors of resistors 34 and 40 are coupled to the top rail supply terminal, for example, $V_{cc}$. The first half of the first stage current feedback circuit provides transistors 44 and 50 having commonly coupled base terminals at the first conductor of resistor 34. The collector terminal of transistor 44 is coupled to the top rail supply terminal and the emitter terminal of transistor 44 is coupled to a first conductor of current source 46. A second conductor of current source 46 is coupled to the bottom rail supply terminal. The collector terminal of transistor 50 is coupled to the bottom rail supply terminal and the emitter terminal of transistor 50 is coupled to the first conductor of current source 48. A second conductor of current source 48 is coupled to the top rail supply terminal. The second half of the first stage current feedback circuit provides transistors 52 and 54 having commonly coupled emitter terminals at a first conductor of resistor 56. The base terminal of transistor 52 is coupled to the emitter terminal of transistor 50 and the base terminal of transistor 54 is coupled to the emitter terminal of transistor 44. The collector terminal of transistor 52 is coupled to the top rail supply terminal and the collector of transistor 54 is coupled to the bottom rail supply terminal.

The first half of the second stage current feedback circuit provides transistors 68 and 70 having commonly coupled base terminals at the first conductor of resistor 40. The collector terminal of transistor 70 is coupled to the top rail supply terminal and the emitter terminal of transistor 70 is coupled to a first conductor of current source 72. A second conductor of current source 72 is coupled to the bottom rail supply terminal. The collector terminal of transistor 68 is coupled to the bottom rail supply terminal and the emitter terminal of transistor 68 is coupled to the first conductor of current source 66. A second conductor of current source 66 is coupled to the top rail supply terminal. The second half of the second stage current feedback circuit provides transistors 60 and 62 having commonly coupled emitter terminals at a second conductor of resistor 56. The base terminal of transistor 60 is coupled to the emitter terminal of transistor 68 and the base terminal of transistor 62 is coupled to the emitter terminal of transistor 70. The collector terminal of transistor 60 is coupled to collector terminal and a control terminal of transistor 58 at the control terminal of transistor 74. The emitter terminal of transistor 58 is coupled to the top rail supply terminal and the collector of transistor 62 is coupled to collector and control terminals of transistor 64 at the base terminal of transistor 76. The emitter of transistor 64 is coupled to the bottom rail supply terminal. It should be noted that resistor 56 is not required and may be a short circuit providing a direct connection to the emitter terminals of transistors 52, 54, 60 and 62.

Transistors 74 and 76 have commonly coupled collector terminals at node 82. The emitter of transistor 74 is coupled to the top rail supply terminal and the emitter terminal of transistor 76 is coupled to the bottom rail supply terminal. The base terminal of transistor 80 is coupled to node 82 and the collector of transistor 80 is coupled to the bottom rail supply terminal. The emitter terminal of transistor 80 is coupled to a first conductor of current source 78 and a second conductor of current source 78 is coupled to the top rail supply terminal. The base terminal of transistor 86 is coupled between first conductors of resistors 94 and 96, the emitter terminal of transistor 86 is coupled to node 102 and the collector terminal of transistor 86 is coupled to the bottom rail supply terminal. The base terminal of transistor 90 is coupled to a second conductor of resistor 94, the emitter terminal of transistor 90 is coupled to node 100 and the collector terminal of transistor 90 is coupled to the bottom rail supply terminal. The base terminal of transistor 92 is coupled to the first conductor of current source 78 at terminal OUT. The collector terminal of transistor 92 is coupled to the top rail supply terminal and the emitter terminal of transistor 92 is coupled to the second conductor of resistor 94. Bypass capacitor 98 is coupled between ground potential, for example, at high impedance node 104.

In steady state, the collector voltages of transistors 36 and 42 are equal, which in turn set the base voltages of transistors 44, 50 and 68, 70 to be equal to the collector voltages of transistors 36 and 42. The current conducted by transistors 52 and 54 is equal to the current conducted by transistors 60 and 62 at steady state. The current conducted by transistors 52 and 54 is given by current sources 46 and 48 and the current conducted by transistors 60 and 62 is given by current sources 66 and 72. The emitter areas of transistors 44, 50, 52, 54, 60, 62, 68 and 70 are preferably equal, but not necessarily so, which defines NPN transistors 44, 52, 60 and 70 to be equivalent transistors and defines PNP transistors 50, 54, 62 and 68 to be equivalent transistors. Current sources 46, 48, 66 and 72 are also made to be preferably identical, but are not necessarily so. The current conducted by transistors 52 and 54 is therefore equivalent to the current conducted by transistors 60 and 62 and the current is equal to the current conducted by current sources 46, 48, 66 and 72. In steady state, the quiescent current conducted by band gap reference 32 is low and well controlled.

The output voltage for band gap reference 32 is provided at terminal OUT. The emitter area of transistor 90 is larger than the emitter area of transistor 86 and therefore provides a difference voltage across resistor 94. The difference voltage across resistor 94 generates a current in resistor 96, which subsequently creates a potential drop across resistor 96. The base-emitter voltage drop across transistor 92, combined with the voltage drops across resistors 94 and 96 provide the output voltage at terminal OUT.

Current sources 38, 46,48, 66, 72, 78, 84 and 88 are all controlled by an enable signal (not shown) which when activated, turns the current sources on and when deactivated, turns the currents sources off. Upon activation of band gap reference 32, using the enable signal discussed above, voltages at the collector terminals of transistors 36 and 42 are not equal. Since the collector voltages of transistors 36 and 42 are not equal, the voltages at the base terminals of transistors 44, 50 and 68, 70 are not equal. In other words, the base drive voltage into the first and second current feedback stages are unequal, which is converted into current drive at terminal 104 using current mirrors. Current mirrors are implemented using transistors 58, 74 and transistors 64, 76. Current is sourced by transistor 74 and current is sinked by transistor 76 depending upon the correction required of band gap reference 32.

At startup, or any other event causing circuit perturbations within band gap reference 32, a difference voltage appears at the collector terminals of transistors 36 and 42 and therefore also appears on the base terminals of transistors 44, 50 and transistors 68, 70. The voltage on the base of transistors 44 and 50 is substantially equal to the voltage on the emitter terminal of transistors 52 and 54, since the voltage on the base terminal of transistor 50 experiences a voltage increase equal to the base-emitter voltage of transistor 50 and a voltage decrease equal to the base-emitter voltage of transistor 52. Similarly, the voltage on the base terminal of transistor 44 experiences a voltage decrease equal to the base-emitter voltage of transistor 44 and a voltage increase equal to the base-emitter voltage of transistor 54. The base-emitter voltages of transistors 50 and 52 are substantially equal, therefore, the emitter voltage of transistor 52 is substantially equal to the base voltage of transistors 44 and 50. Similarly, the voltage on the base of transistors 68 and 70 is substantially equal to the voltage on the emitter terminal of transistors 62 and 60, since the voltage on the base terminal of transistor 70 experiences a voltage decrease equal to the base-emitter voltage of transistor 70 and a voltage increase equal to the base-emitter voltage of transistor 62. Similarly, the voltage on the base terminal of transistor 68 experiences a voltage increase equal to the base-emitter voltage of transistor 68 and a voltage decrease equal to the base-emitter voltage of transistor 60. The base-emitter voltages of transistors 70 and 62 are substantially equal, therefore, the emitter voltage of transistor 62 is substantially equal to the base voltage of transistors 68 and 70.

The difference voltage appearing at the collector terminals of transistors 36 and 42, therefore, also appears across resistor 56, according to the analysis given above. Taking for example, an occurrence whereby the voltage at the collector terminal of transistor 36 is greater than the voltage at the collector terminal of transistor 42, the voltage at the emitter terminal of transistor 52 is greater than the emitter voltage at the emitter terminal of transistor 62. The difference in emitter potentials between transistors 52 and 62 creates a current flow through transistors 52 and 62, which is significantly higher than the steady state quiescent current flowing through transistors 52 and 62. The current flowing through transistors 52 and 62 is mirrored by the current mirror implemented by transistors 64 and 76. The mirror current is conducted by transistor 76, which sinks current from node 104, discharging capacitor 98.

Conversely, taking for example, an occurrence whereby the voltage at the collector terminal of transistor 42 is greater than the voltage at the collector terminal of transistor 36, the voltage at the emitter terminal of transistor 60 is greater than the emitter voltage at the emitter terminal of transistor 54. The difference in emitter potentials between transistors 60 and 54 creates a current flow through transistors 60 and 54, which is significantly higher than the steady state quiescent current flowing through transistors 60 and 54. The current flowing through transistors 60 and 54 is mirrored by the current mirror implemented by transistors 58 and 74. The mirror current is conducted by transistor 74, which sources current into node 104, charging capacitor 98.

A first advantage, therefore, provided by band gap reference 32 is provided by the low noise capability afforded by bypass capacitor 98 interacting with high impedance node 104 to create a low pass filter having cutoff frequency $f_{cutoff}=1/2\pi R_d C_{bypass}$, where $R_d$ is the equivalent dynamic impedance at node 104 and $C_{bypass}$ is the capacitance value of capacitor 98. A second advantage of band gap reference 32 is provided by the charge and discharge currents created at node 104 to charge and discharge capacitor 98. The charge and discharge currents at node 104 serve to reduce the amount of time required to charge and discharge capacitor 98 during perturbations such as power on events or voltage transients on top rail supply $V_{cc}$, thus allowing band gap reference 32 to be utilized in high frequency/low power applications. Band gap reference 32 operates on low quiescent current during steady state operation and provides fast reaction times during voltage perturbations using increased charging or discharging currents.

In summary, a band gap reference is presented which provides low quiescent current operation during steady state conditions with improved reaction times to circuit perturbations caused by power on or voltage transients existing on the top rail supply terminal.

What is claimed is:

1. A band gap reference circuit, comprising:

a current source providing a current to a charging node operating at a potential that determines an output voltage of the band gap reference circuit; and a differential input stage coupled for sensing the output voltage to produce an error signal for controlling a magnitude of the current.

2. The band gap reference circuit of claim 1 wherein the differential input stage comprises:

a first transistor having a control terminal coupled to receive a first feedback signal representative of the output voltage and a first conductor coupled to provide a first component of the error signal; and a second transistor having a control terminal coupled to receive a second feedback signal representative of the output voltage and a first conductor coupled to provide a second component of the error signal.

3. The band gap reference circuit of claim 2 wherein the current source comprises:

a first current mirror circuit that receives the first component of the error signal for charging the node with the current;

a second current mirror circuit that receives the second component of the error signal for discharging the node with the current.

4. A band gap reference circuit comprises:

a current source providing a current to a charging node operating at a potential that tracks an output voltage of the band gap reference circuit, the current source having a first current mirror circuit that receives a first component of an error signal for charging the node with the current;

a first feedback stage having a first transistor with a control terminal coupled to receive the first component of the error signal and having a conduction terminal coupled to a second node;

a second transistor of the first feedback stage having a control terminal coupled to receive a second component of the error signal and having a conduction terminal coupled to the second node;

a second current mirror circuit of the current source that receives the second component of the error signal for discharging the node with the current;

a differential input stage having a first transistor having a control terminal coupled to receive a first feedback signal representative of the output voltage and a first conductor coupled to provide the first component of the error signal; the differential input stage coupled for sensing the output voltage to produce the error signal for controlling a magnitude of the current;

a second transistor of the differential input stage having a control terminal coupled to receive a second feedback signal representative of the output voltage and a first conductor coupled to provide the second component of the error signal.

5. The band gap reference circuit of claim 4 wherein the first current mirror comprises:

a third transistor having a first conductor coupled to a control terminal of the third transistor at a third node; and a fourth transistor having a control terminal coupled to the third node and having a conduction terminal coupled to the first node to provide the first charge signal.

6. The band gap reference circuit of claim 4 wherein the current feedback stage further comprises:

a second feedback stage having a control input coupled to receive the differential error signal and coupled to provide a second current control signal; and a second current mirror having a control input coupled to receive the second current control signal and a conduction terminal coupled to provide the second charge signal at the first node.

7. A method of generating a reference signal, comprising:

sensing a change in the reference signal to adjust a magnitude of a current;

supplying the current to a node to modify a node potential; and level shifting the node potential to correct the reference signal.

8. The method of claim 7 further comprising: creating a reference signal derived from a supply potential;

providing a signal as a function of a change in the reference signal to produce an error signal;

providing a second charging signal from a second current feedback stage in response to the error signal;

sinking a current from a node by a current source controlled by a second current mirror in response to the second charging signal.

9. The method of claim 7, wherein the step of supplying includes the step of increasing the charging current when the reference signal decreases.

10. The method of claim 9, further comprising the step of discharging the node with a discharging current when the node potential increases.

* * * * *